US005200038A

United States Patent [19]

Brown

[11] Patent Number: 5,200,038

[45] **Date of Patent: * Apr. 6, 1993**

[54] PULP REFINER WITH FLUIDIZING INLET

[75] Inventor: Kenton J. Brown, Mobile, Ala.

[73] Assignee: International Paper Company, Purchase, N.Y.

[ * ] Notice: The portion of the term of this patent subsequent to Apr. 11, 2006 has been disclaimed.

[21] Appl. No.: 271,549

[22] Filed: Nov. 15, 1988

Related U.S. Application Data

[60] Continuation-in-part of Ser. No. 112,326, Oct. 26, 1987, Pat. No. 4,820,381, which is a division of Ser. No. 20,150, Feb. 25, 1987, abandoned, which is a continuation of Ser. No. 770,169, Aug. 38, 1985.

[51] Int. Cl.[5] ..... B02C 7/02; B02C 7/06; B02C 13/20; D21D 1/30

[52] U.S. Cl. ..... 162/261; 241/245; 241/261.2

[58] Field of Search ..... 162/261, 28, 57, 243, 162/100; 241/28, 163, 261.2, 245

[56] References Cited

U.S. PATENT DOCUMENTS

| | | | |
|---|---|---|---|
| 4,253,613 | 3/1981 | Reinhall | 241/28 |
| 4,283,016 | 8/1981 | Reinhall | 241/28 |
| 4,288,288 | 9/1981 | Fleck | 162/57 |
| 4,339,206 | 7/1982 | Ahs | 162/243 |
| 4,610,400 | 9/1986 | Sjobom | 241/261.2 |
| 4,820,381 | 4/1989 | Brown | 162/261 |

*Primary Examiner*—Steve Alvo
*Attorney, Agent, or Firm*—Walt Thomas Zielinski

[57] ABSTRACT

A pulp fluidizer and pulp refiner apparatus. Paper pulp stock of either low (3-8%) or medium (8-15%) fiber consistency is fed from the fluidizer portion of the apparatus to the refiner. The construction is such that the outlet of the fluidizer is contiguous to the inlet of the refiner. This geometrical relation permits the deflocculated pulp from the fluidizer outlet to be fed substantially immediately to the refiner inlet, prior to its naturally occurring reversion to a flocculated state. By providing the input of the disc refiner with deflocculated paper pulp stock, higher pulp stock consistencies can be worked by the refiner, resulting in savings of energy, equipment and space.

8 Claims, 5 Drawing Sheets

FIG. 1
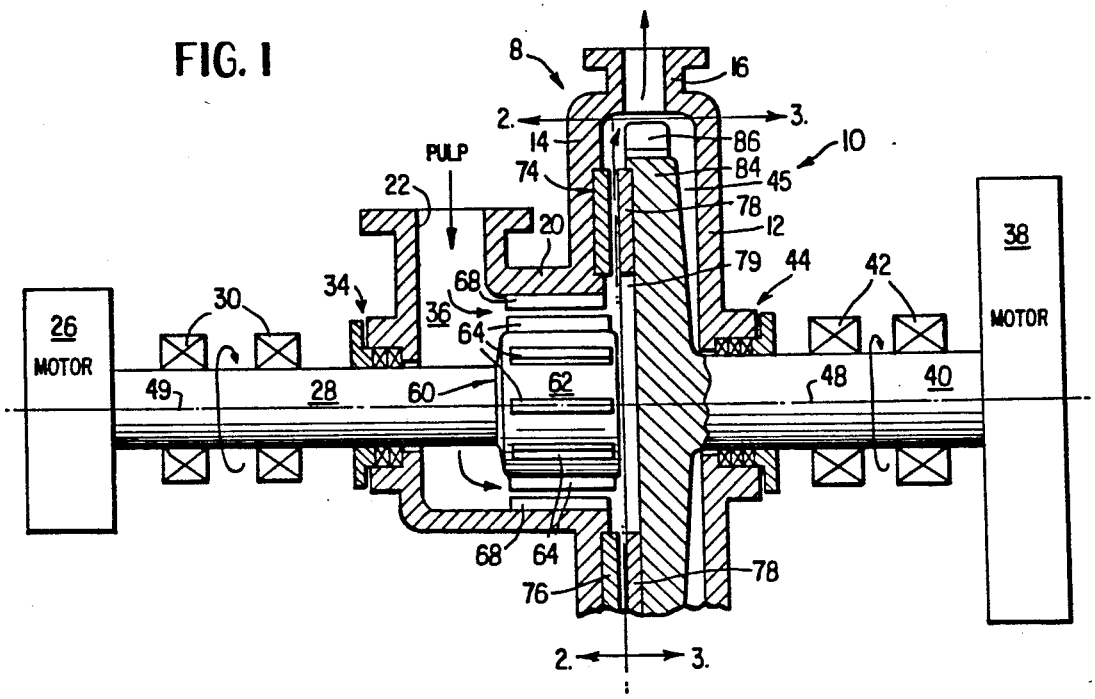
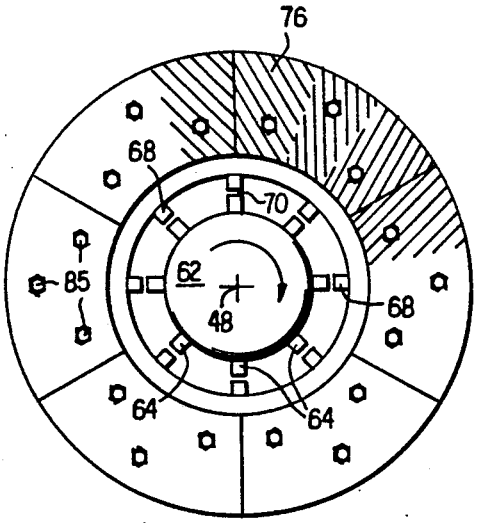
FIG. 2
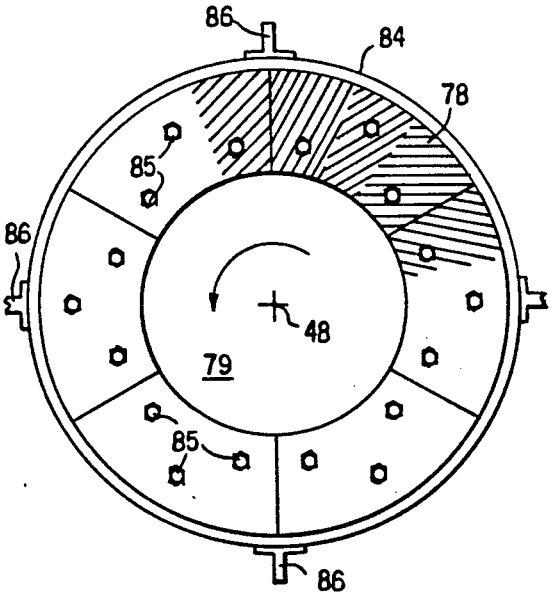
FIG. 3

FIG. 4
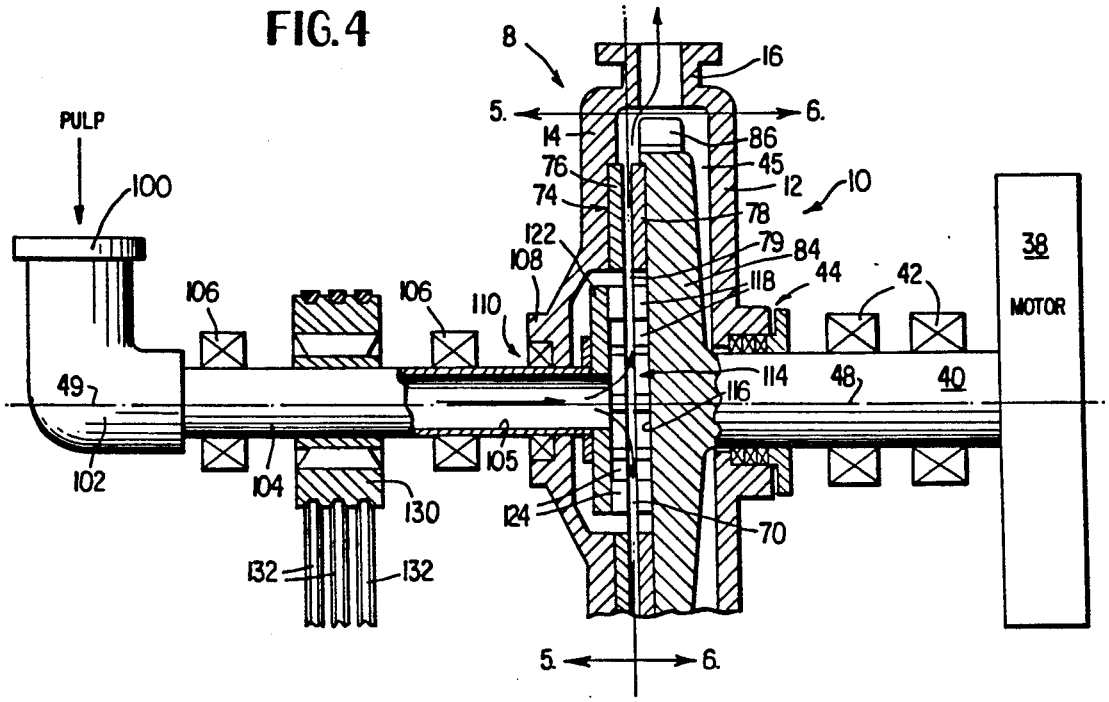
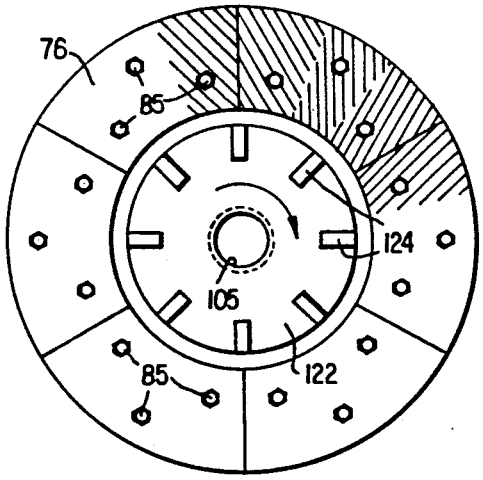
FIG. 5
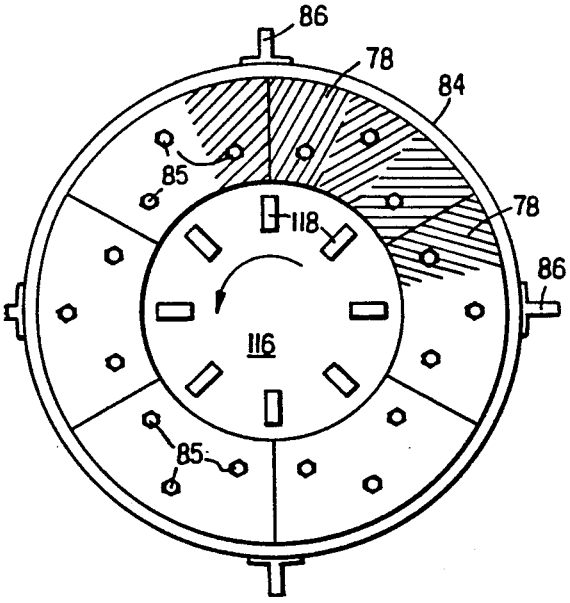
FIG. 6

PULP REFINER WITH FLUIDIZING INLET

This application is a continuation in part of my copending application Ser. No. 07/112,326 filed Oct. 26, 1987, now U.S. Pat. No. 4,820,381, which was a divisional application of my copending application Ser. No. 020,150 filed Feb. 25, 1987 now abandoned, which was a continuation of my now abandoned application Ser. No. 770,169 filed Aug. 28, 1985, now abandoned.

BACKGROUND OF THE INVENTION

This invention relates to the art of papermaking and more particularly to an apparatus and method of treating paper pulp stock. Paper pulp of relatively low consistency (3 to 8% fiber content) has been fed to a refiner, such as a disc refiner. There, the individual fibers of the pulp stock slurry are cut and/or fractured so as to render the stock suitable for papermaking.

For the purpose of increasing the efficiency of such papermaking operations, it is desirable to treat pulp by a disc refiner having a higher fiber content, such as a fiber content of from 8 to 18%. However, such attempts have usually failed because this higher fiber content results in a jamming or clogging of the disc refiner. Once the refiner commences to clog, total clogging occurs shortly thereafter with the result that the disc refiner is no longer operable. In attempting to feed medium pulp consistencies to a disc refiner, such as pulp stock having a fiber content of from 8 to 18%, flocculation of the fibers with the slurry causes the above described clogging of the disc refiner.

Prior to this invention, mechanical devices for fluidizing medium consistency paper stock had been known. Such devices include a fluidizing device sold by Kamyr, Inc. under the brand name MC Pump, and is characterized by the seller as a centrifugal, thickstock pump. This is a rotary device for deflocculating paper pulp. Such devices have previously been useful, for example, in pumps for pumping paper stock of medium consistency from a storage tank to another portion of the papermaking system. It has been found that medium consistency pulp exhibits high pipe-clogging characteristics and a fluidizer, such as the Kaymr MC Pump, serves to deflocculate the medium consistency pulp in a pulp storage tank or chest, to thereby enable it to be passed in hydraulic conduits without clogging.

Another common configuration for a pulp refiner is a rotating flat disc attached at a right angle to an end of a shaft. In comparison with the disc refiners, conical refiners, such as the subject of the present invention, have been found to be advantageous with respect to refined pulp properties and energy consumption. Comparison trials made during the past two years showed that paper made from pulp refined conically has 5 to 15% better strength properties than that made from disc refined pulp. At the same time, energy required to develop a given level of paper strength was 30 to 40% less for the conical refiner.

More uniform fiber treatment by the conical refiner is an apparent explanation for its superior results. Because the speed of the moving bars in a refiner determines the quality of treatment of the fibers and the amount of energy required to shear the pulp slurry, an ideal refiner would have all positions along the bars moving at equal speeds. This suggests a cylindrical refiner, but a cylindrical refiner which allows a pulp slurry to be passed through it continuously in an axial direction has been found to be almost impossible to design feasibly. The closest and most successful approach to this ideal configuration is the conical refiner, the subject of this invention.

Because a disc refiner's configuration resembles that of a pump, a considerable portion of the energy it consumes is expended in pumping the pulp slurry rather than refining it. Depending on its speed of rotation, from 50 to 75% of the power required by a disc refiner can go into pumping rather than refining. Considerably less pumping, and therefore considerably less secondary function power usage, is done by a conical refiner. The conical refiner's configuration also lends itself better to the insertion of a pulp fluidizer at its inlet. As will be discussed in detail in the description of an embodiment of the present invention, the flow of pulp through the fluidizer and the refiner follows a straight path and the distance between the two sections can be minimized. In a nominal sized conical refiner, a distance of one inch produces a transient time of only 0.07 seconds at a refining flow rate of 200 gallons per minute. Due to this close proximity of the conical refiner to the fluidizer, a shorter dwell time can be achieved than in the case of a disc configuration, and it is the shorter dwell time which inhibits reflocculation of the pulp, which is the object of the device of the present invention.

SUMMARY OF THE INVENTION

Prior to this invention, it has not been possible to treat paper stock having a fiber consistency greater than the range of 3 to 8% in a conventional disc refiner. By the practice of this invention, a fluidizer is placed in series with a disc refiner. The action of the fluidizer is to deflocculate the paper stock of medium consistency (8–18%) so as to provide the input of the disc refiner with deflocculated stock. It is known, however, that deflocculated stock, such as stock which has been fluidized as by a Kaymr MC Pump, this being a fluidizing device, will very quickly revert to a flocculated state. To overcome this natural tendency of "decay", i.e., reflocculation, the present apparatus and method is such that substantially immediately after leaving a fluidizer, the medium consistency pulp is passed to the input of a disc refiner. By this arrangement, the disc refiner is substantially free from clogging, even though it is operating on medium consistency pulp stock. In the disc refiner, as is well known, the action is such as to unwind or fibrilate the fibers, as well as splitting them and cutting them. After exiting from the output of the disc refiner of this apparatus, it is believed that the liquid stock will again quickly revert to a flocculated state. However, the action of refining the stock has already taken place and hence such "decay" or reflocculation has no effect on subsequent pulp operations.

BRIEF DESCRIPTION OF THE DRAWINGS

FIG. 1 is a partial cross-sectional view illustrating the apparatus of this invention according to a first embodiment.

FIG. 2 is a view taken along Section 2—2 of FIG. 1.

FIG. 3 is a view taken along Section 3—3 of FIG. 1.

FIG. 4 is a view similar to FIG. 1 and illustrates a second embodiment of the invention.

FIG. 5 is a view taken along Section 5—5 of FIG. 4.

FIG. 6 is a view taken along Section 6—6 of FIG. 4.

DETAILED DESCRIPTION OF THE INVENTION

Figure 7:
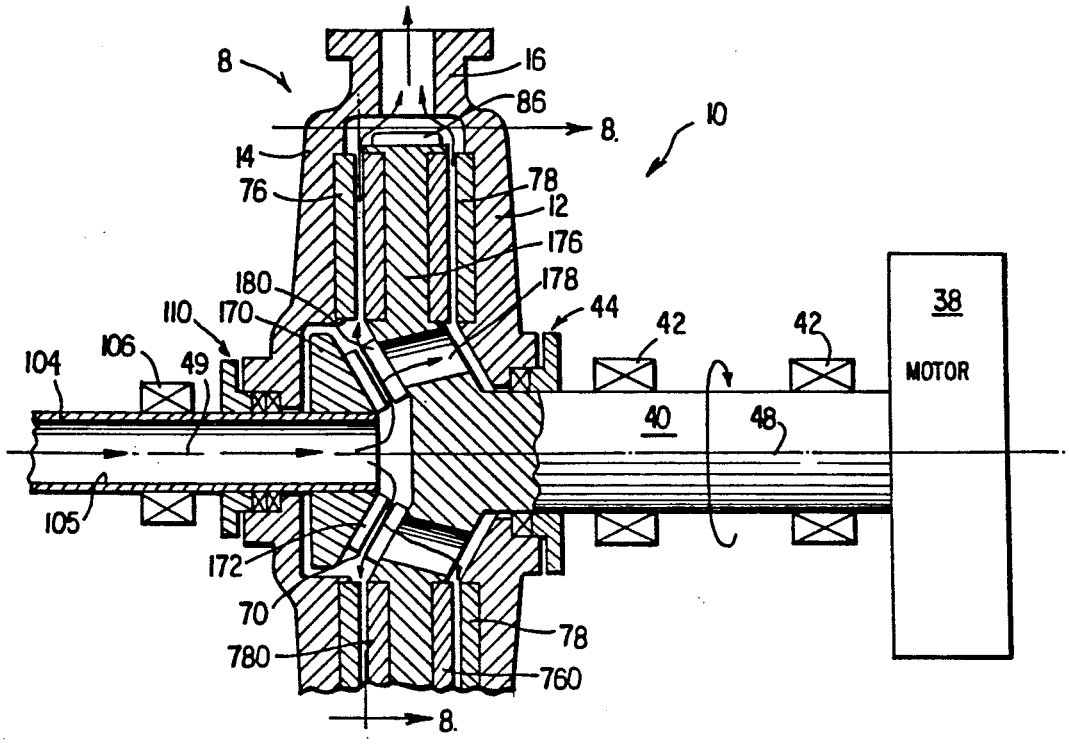
FIG. 7 is a view similar to FIG. 1 and illustrates a third embodiment of the invention.

Turning now to FIGS. 1-3 of the drawings, the numeral 8 denotes generally the apparatus of this invention according to a first embodiment, the apparatus 8 including a hollow casing or housing 10. The numeral 12 denotes one side portion of the generally annular and hollow casing 10, while the numeral 14 denotes the other side. The numeral 16 denotes a single, radially projecting outlet or duct formed in the casing, for carrying away from the apparatus 8 paper pulp stock which is to be treated. The numeral 20 denotes a generally cylindrical tubular portion integral with and adjacent to side 14 of the casing, tubular portion 20 having an inner cylindrical surface. The numeral 22 denotes an inlet nozzle portion, integral with tubular portion 20 of the casing side 14, this inlet portion being adapted to receive liquid pulp stock of medium consistency which is to be treated. The numeral 26 denotes a motor, such as an electric motor, having a speed of, typically, 3600 rpm. The numeral 28 denotes a shaft driven by motor 26, the shaft being supported by rotary bearings denoted schematically by the numeral 30. The curved arrow surrounding shaft 28 denotes a typical direction of rotation of the shaft. The numeral 34 denotes a rotary joint seal between the interior of inlet portion 22 and the exterior of shaft 28, a portion of shaft 28 passing into a pulp inlet chamber 36 of the left portion of the casing.

The numeral 38 denotes a second motor, also typically an electric motor and having a speed of rotation, for example, of 900 rpm. The motor 38 turns shaft 40, the latter being supported by rotary bearings denoted schematically by the numeral 42. The numeral 44 denotes a rotary shaft seal to the interior 45 of the casing and the exterior of shaft 40. The numeral 48 denotes the axis of rotation of shaft 40 while numeral 49 denotes the axis of rotation of shaft 28. The reader will observe that these two axes of rotation are colinear or coaxial.

The numeral 60 denotes generally a pulp fluidizer, partially defined by an enlargement 62 integrally formed on one end of shaft 28, the enlargement 62 having an outer cylindrical surface thereon. The numeral 64 denotes any one of a plurality of angularly spaced bars or other raised portions on the outer cylindrical surface 62, the bars lying in a generally axial direction, parallel to the axis of rotation 49.

The numeral 68 denotes any one of a plurality of similar, also angularly disposed bars, the bars lying on the interior cylindrical surface of portion 20 of the left casing side 14. As shown at FIG. 2, the numeral 70 denotes a radial clearance between corresponding bars 64 and 68. Typically, this clearance is in the order of 0.03-0.05 inches (0.76-1.27 mm). The pulp fluidizer is thus defined by surface 62 with its bars 64 and by the cylindrical surface of portion 20 with its bars 68.

The numeral 74 denotes a disc refiner of generally conventional construction. The disc refiner is defined by a first or left hand disc 76, the disc being defined by a plurality of ridges and grooves on its right hand face which are in opposing relation to similar ridges and grooves on the left hand face of a similar disc denoted by the numeral 78. As shown in FIG. 1, and as is conventional, discs 76 and 78 are apertured, and may be considered as circular disc members each with a central aperture therein. The numeral 79 denotes generally the input zone (annularly continuous) to the disc refiner 74, and the reader will observe that input 79 is contiguous to the right hand edges of bars 64 and 68 of fluidizer 60 and is also in the same general radial plane as the radial plane which contains the right hand ends of bars 64 and 68.

Right hand disc 78 of disc refiner 74 is carried by a radially enlarged portion 84 integral with shaft 40 and at one end of the latter. As seen most clearly at FIGS. 2 and 3, discs 76 and 78 are each defined by, typically, six segments, with each segment being secured to its respective carrier or mounting (14 for segments of disc 76 and 84 for segments of disc 78) by means of bolts or rivets which pass through apertures 84 in the disc segments. Preferably, for a purpose which will later be described, the periphery of enlarged portion 84 of shaft 40 is provided with a plurality of angularly spaced and radially extending blades 86. The function of blades 86 is to wipe a portion of the interior 45 of the casing, as will presently be described.

The operation of the apparatus shown at FIGS. 1-3 will now be described. Paper pulp, such as pulp of medium consistency, is fed into opening 22 of the left hand portion of the casing. Motor 26 turns shaft 28, so that the pulp when entering the left hand or entrance portion of fluidizer 60 will become deflocculated. The term deflocculate is intended to refer to the breaking up of lumps of agglomerated or bunched fibers in the paper pulp stock. After passing through fluidizer 60, from left to right as viewed at FIG. 1, the now deflocculated pulp passes radially outwardly from the exit portion of fluidizer 60 to the input 79 of disc refiner 74. As is conventional with disc refiners, the spacing between the axially projecting ridges of each of the discs is in the order of 0.001 to 0.003 inches (0.025-0.075 mm). The disc refiner operates on the deflocculated medium consistency paper pulp stock to perform the functions of fibrillation, splitting and cutting, as is conventional in this art. It is believed that after passing radially outwardly from the disc refiner 74, the pulp will very shortly revert or decay to its flocculated state. Such a flocculated state will generally cause clogging and for this purpose blades 86 wipe the radially outermost portion of the interior of the casing to thereby assist in the expulsion of the treated paper stock through the single, radially disposed exit duct 16 of the casing. From this point the paper stock is fed, typically, to a paper machine chest.

It is preferable in the process described that shaft 28 be rotated at a significantly higher speed of rotation than that of shaft 40. Assuming both shafts to rotate in the same, indicated direction, motor 26 would turn at 3600 rpm while motor 38 would turn at 900 rpm. Clearly, the shafts 28 and 40 may turn in opposite directions as well.

Turning now to FIGS. 4, 5 and 6 of the drawings, a second embodiment of the invention will now be described. Those portions of the apparatus which are similar to the embodiment of FIGS. 1-3 bear the same reference numerals, and accordingly a description of them need not be again offered. The numeral 100 denotes a portion of a second casing which is apertured and which receives pulp of medium consistency. The numeral 102 denotes generally a rotor joint housed within this casing, the rotary joint receiving rotary hollow shaft 104, the latter rotating in schematically indicated rotary bearings 106. The numeral 110 denotes a rotary seal for sealing the exterior of shaft 105 from the interior of the casing. The numeral 114 denotes generally a fluidizer of a second construction, the fluidizer including first and second hub elements. The numeral 122 denotes a first hub member in the form of a centrally apertured disc, carried by and fixedly secured to the exit (right) end of hollow shaft 104. The right face of hub 122 is provided with a plurality of radially oriented, uniformly angularly spaced bar protuberances 124. The numeral 116 denotes a second hub member, opposite to the first hub 122, and also carrying a plurality of radially oriented, uniformly angularly spaced bar protuberances 118. Hub member 116 is an integral portion of radially enlarged portion 84 of rotary shaft 40. The axial spacing between corresponding protuberances 118 and 124 is substantially the same as the radial spacing of bars 64 and 68 of the embodiment of FIGS. 1-3. The numeral 130 denotes a grooved pulley which is, in any conventional manner, fixedly secured to the exterior of rotary, hollow shaft 104 and is rotated by a plurality of belts 132 which are in turn driven by a motor, such as an electric motor, not illustrated.

The mode of operation of this second embodiment is as follows. Medium consistency pulp containing flocculations is fed into the inlet 100 and passes to rotary joint 102 where it then passes through the interior of hollow shaft 104 which rotates about axis 49. The shaft 104 is caused to rotate by pulley 130 rotated by belts 132. At the same time, the other motor 38 is rotating shaft 40 to operate the disc refiner 74, the latter being of the same construction as that previously described. Again, a typical speed of rotation of shaft 104 would be 3600 rpm, while a typical speed of rotation of motor 38 would be 900 rpm, with the shafts being rotated in the indicated direction shown by the curved arrows. Upon exiting from the right hand portion of hollow shaft 104, the deflocculated, medium consistency pulp flows radially outwardly and between the protuberances 118, 124 of fluidizer 114. After passing through the fluidizer the now deflocculated pulp passes radially outwardly to the same annularly continuous inlet 79 of disc refiner 74 as that previously described. The action from this point on is the same as that previously described.

Figure 8:
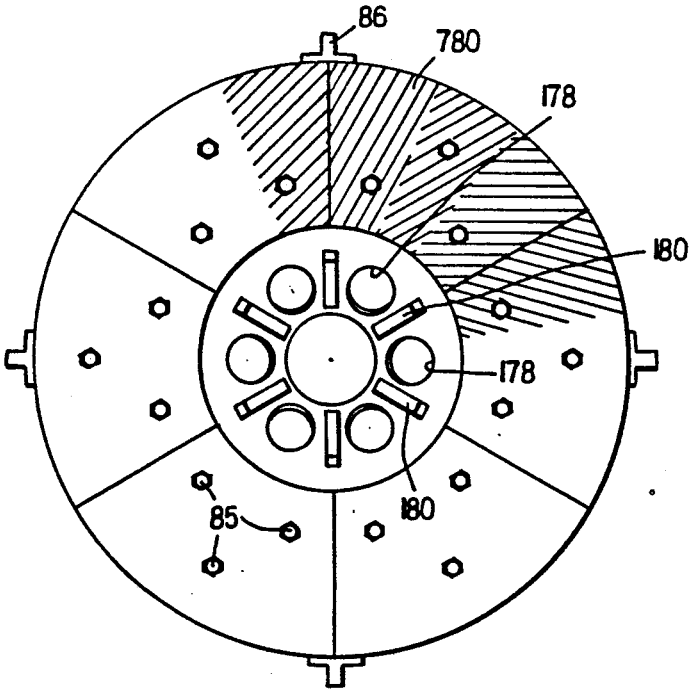
FIG. 8 is a view taken along Section 7—7 of FIG. 7.

Referring now to FIGS. 7 and 8, a third embodiment of the invention will now be described. Certain elements of this third embodiment are similar to those of the embodiment of FIGS. 4-6. At FIG. 7, hollow shaft 104 having a bore 105 is rotated, as by an arrangement such as pulley 130 of FIG. 4. Paper pulp stock to be fluidized, i.e., deflocculated, is fed from left to right through bore 105. Numeral 170 represents a hub or disc element which is centrally apertured and which fixedly receives the right hand end of shaft 104. The right hand face of hub 170 is provided with a plurality of spaced and annularly continuous protuberances 172, again in the form of radially positioned bars.

The numeral 176 denotes the left end of shaft 40, driven by motor 38, portion 176 being radially enlarged and integral with shaft 40. Numeral 178 denotes any one of a plurality of uniformly annularly spaced through passage ports extending from the left to the right radial face of enlargement 176, the ports are slanted slightly radially outwardly and are spaced relatively close to the axis of rotation 48. The numeral 180 denotes a plurality uniformly annularly spaced protuberances, again in the form of bars, bars 180 being fixed to the left face of radial enlargement 176 at the same general radial location as ports 178. As may be seen by reference to FIG. 8, ports 178 are angularly spaced with the radially disposed bars 180.

The embodiment of FIG. 4 of this invention utilizes a so-called single disc refiner. Most of those disc refiners which are currently in vogue employ a double disc. The embodiment of FIG. 7 is thus similar to the embodiment of FIG. 4 except that in FIG. 7 a double disc refiner is illustrated. Again, the numeral 76 denotes a left hand segmented disc fixed and mounted in left hand casing portion 14, while the numeral 78 denotes a corresponding right hand segmented disc fixedly positioned and carried by right hand casing portion 12. The numeral 780 denotes the disc which cooperates with disc 76, while the numeral 760 denotes the disc which cooperates with disc 78. Each of the disc pairs illustrated is of a construction identical with discs 76, 78 which have been previously described. The mode of operation of this third embodiment of the invention is as follows. Paper pulp stock fed into the bore 105 by an arrangement such as shown in FIG. 4 exits from the right hand end of hollow shaft 104 and passes radially outwardly to the radially innermost portions of relatively rotating bars 172, 180. Again, the clearance between the bars is indicated by the numeral 70 and is of the same order of magnitude as that previously described with respect to the embodiments of FIGS. 1 and 4. One portion of the treated paper stock which is fluidized by relatively rotating bars 172, 180 passes up through the left portion of the casing 10 to the first disc refiner, while a second portion of the fluidized paper stock pulp passes axially to the right through ports 178 and to the inlet of the second disc refiner. The radially outermost outputs from the two disc refiners then combine to flow from casing 10 radially outwardly through duct 16 to again typically, a paper machine chest. Again, one or more wiping blades 86 is affixed to the radially outermost portion of the disc refiners to assist in the prevention of clogging on the interior of the casing which might be caused by reflocculation.

Referring now to FIGS. 9-13, a description will now be offered of further embodiments of the invention wherein both the fluidizer and the refiner is of conical form, or wherein the fluidizer is of conical form and the refiner is of disc form. The same reference numerals are employed as with the previously described embodiments for those elements which are of the same shape.

Figure 9:
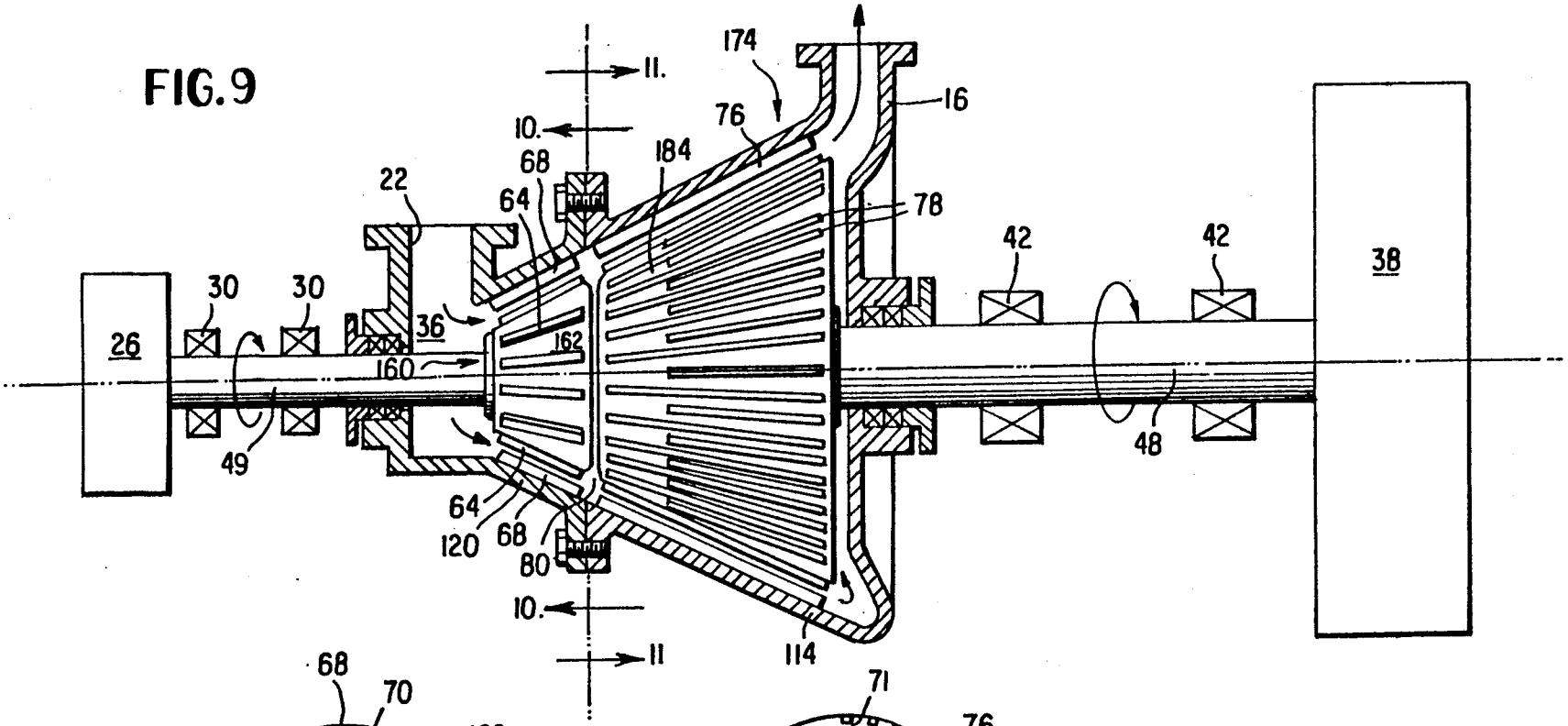
FIG. 9 is a partial cross-sectional view, partially schematic, illustrating the apparatus of this invention in accordance with a first embodiment employing conical fluidizer and refiner elements.
Figure 10:
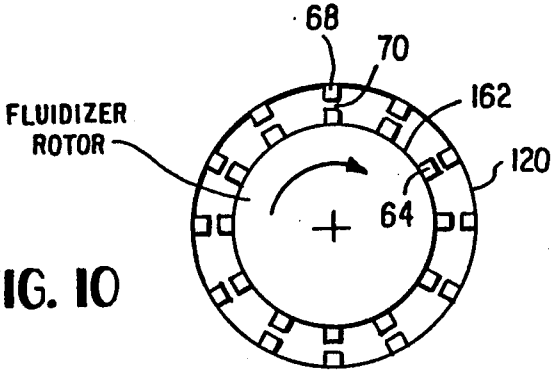
FIG. 10 is a partial view taken along Section 10—10 of FIG. 9.

Referring now to FIG. 9 of the drawings, the same general arrangement of parts is shown as that illustrated in FIG. 1, except that the cylindrical fluidizer 60 of FIG. 1 is replaced with a conical fluidizer 160 having a conical exterior surface 162 provided with a plurality of angularly spaced bars 64. The numeral 120 denotes a part conical casing portion having a plurality of angularly spaced bars 68 on its inner surface. As indicated at FIG. 10, the numeral 70 denotes the radial clearance between parallel bars 64 and 68 as measured normally between them.

Figure 11:
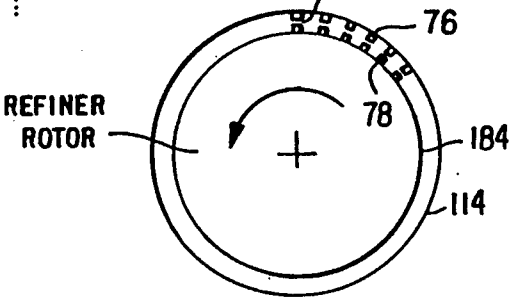
FIG. 11 is a partial view taken along Section 11—11 of FIG. 9.

The numeral 184 denotes a conically shaped refiner whose surface carries a plurality of angularly spaced bars 78. A conically shaped casing 114 carries a plurality of angularly spaced bars 76 on its inner surface. As indicated in FIG. 11, the radial clearance between bars 76 and 78 is denoted by the numeral 71. The reader will observe that the radial spacing 70 is greater than the radial spacing 71 so that the pulp fibers are not damaged. The other elements shown at FIG. 9 correspond to those previously described with respect to the embodiment of FIG. 1. The conical refiner by itself is available in the marketplace and is used commercially to refine papermaking pulp at low consistencies around 3 and 4%. Attempts to increase the efficiency of the refiner by increasing the slurry results in clogging the refiner. Placing a high-speed pulp fluidizer in series with the conical refiner deflocculates higher consistency pulps so they can flow uniformly through the refiner without clogging it. Thus, the fluidizer permits the refiner to treat pulps at consistencies of up to 18%.

In operation, the pulp passes through inlet nozzle portion 22 and into pulp inlet chamber 36. As indicated by the curved arrows, the pulp passes from this region between the conical fluidizer and the interior of conical casing portion 120 where it becomes deflocculated as it passes through the high shear zone of gaps 70. The flow of the pulp is thus both slanting radially outwardly and axial (horizontally as shown in the figure) and then passes to the left end of the refiner. From this entrance end of the refiner, the pulp, similarly, flows slantingly radially outwardly as well as axially where it is refined as it is treated mechanically in gaps 71 until it exits at duct 16, where it is subsequently treated. The clearances 70 and 71 are the same as those previously described with respect to the embodiment of FIG. 1, namely, the gap 70 is greater than gap 71 so that the fibers are not damaged. Also as previously described, the speed of rotation of the fluidizer is usually greater than the speed of rotation of the refiner. A greater deflocculation takes place in gaps 70 than in gaps 71 due to the speed of rotation of the fluidizing motor 26 being greater than that of refiner motor 38. While the fluidizer and refiner are usually operated in the same direction of rotation, these directions of rotation could be changed so as to be opposite to each other.

The numeral 80 denotes the space between the trailing end of the bars 64 on the fluidizer and the leading end of bars 76 on the refiner. Minimizing space 80 minimizes the opportunity for the fluidized pulp to revert or decay to a flocculated state. Furthermore, because fluidized pulp will revert faster if its flow path is diverted away from the path in which it exits the fluidizer, the conical angle of the fluidizer surface 162 should be identical to the conical angle of surface 184 of the refiner. In this way, the pulp flows in the same conical plane from fluidizer to refiner so that diversions in flow that would cause reflocculation are avoided.

The rotary elements of the fluidizer and of the refiner are described as conical although they are both shown as truncated cones. The fluidizer can, in theory, be truncated conical (as shown) or conical. However, the refomer must be truncated or part conical (as shown) in order that its inlet or input periphery linearly receive the output from the periphery of the fluidizer.

Figure 12:
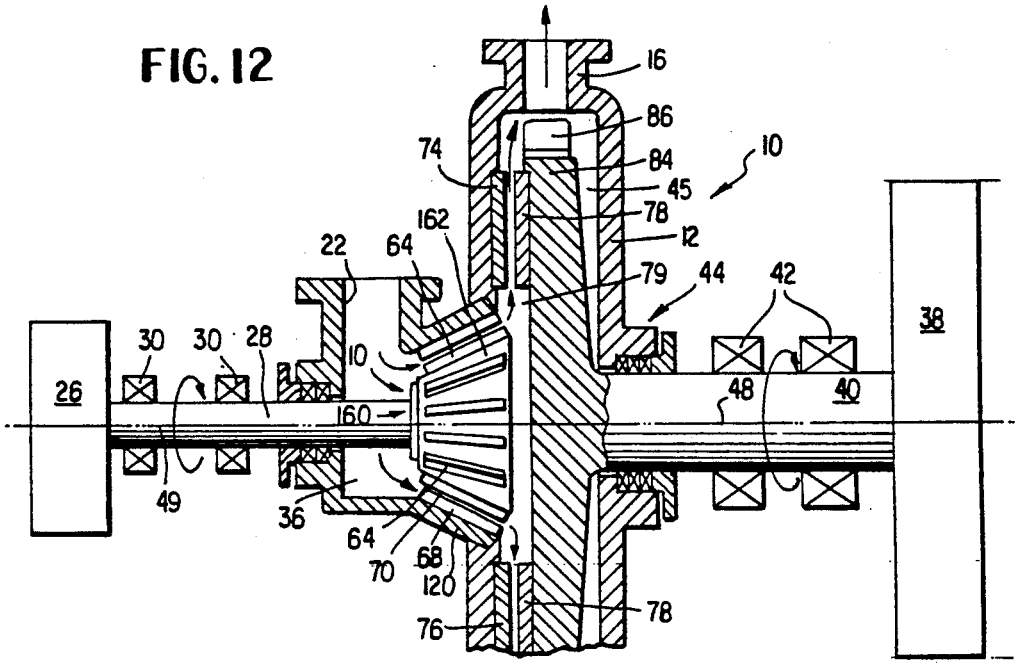
FIG. 12 is a partial cross-sectional view, similar to FIG. 9, and illustrates a conical fluidizer fitted to the inlet of a single disc refiner.

Referring now to FIG. 12, a pulp refining and fluidizing apparatus is illustrated which is again similar to that shown at FIG. 1, except that the fluidizer is provided with a conical member 160 having bars 62 thereon, the latter mounted on part conical surface 162. Bars 64 cooperate with bars 68 on part conical housing 120 as previously described with respect to the embodiment of FIG. 9. The larger diameter of part conical element 160 is so positioned that its face is of the same vertical plane which is substantially midway between the facing portions of bars 74 and 78 on the illustrated disc type refiner. The construction of the refiner portion of the apparatus illustrated FIG. 12 is the same as that described with respect to FIG. 1. In operation, pulp is fed to inlet nozzle portion 22 and enters zone 36 therein. Thereafter, as indicated by the curved arrows, it flows along the spaces between bars 64 and 68 and over conical surface 162 to thereby fluidize the pulp. The clearance between bars 64 and 68 is the same as that shown at FIGS. 2 and 10 of the drawings. From the right hand or larger diameter portion of conical member 160 the pulp flows radially outwardly, as indicated by the curved arrow, to the entrance or radially innermost portion between bars 74 and 78 of the refiner. Then, as indicated by the curved arrows, it flows radially outwardly for subsequent treatment.

Figure 13:
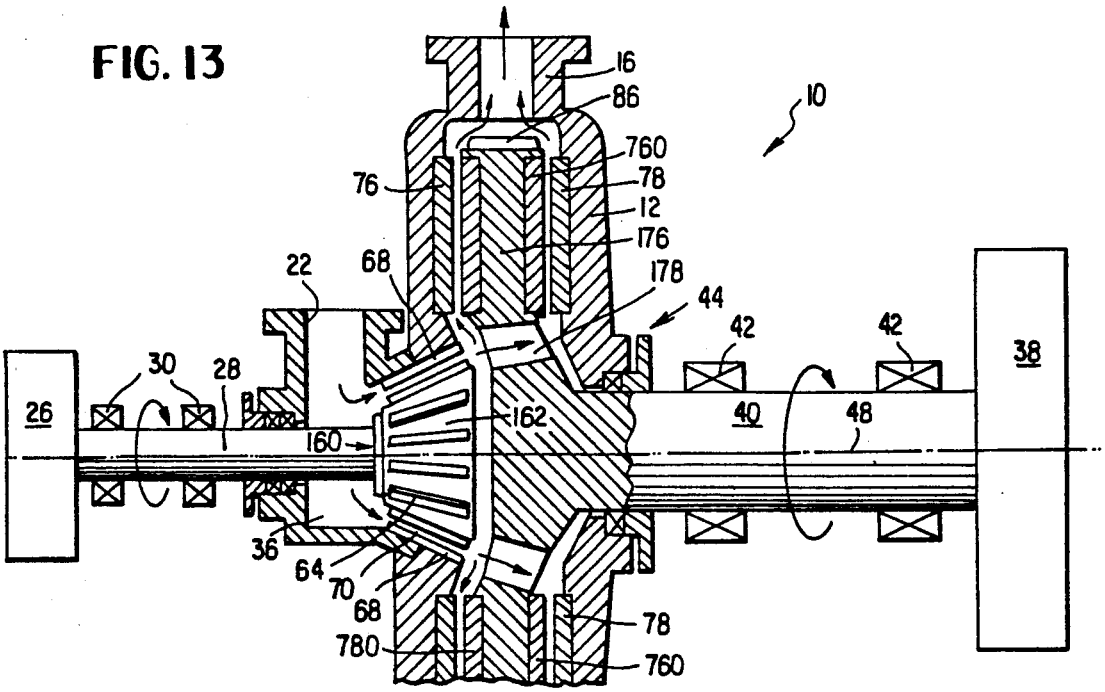
FIG. 13 is a view similar to FIG. 1 and illustrates a conical fluidizer fitted to the inlet of a double disc refiner.

Referring now to FIG. 13 of the drawings, the numeral 10 again denotes a pulp refiner and fluidizer apparatus employing a conical fluidizer section. Again, the conical section denoted by the numeral 160 has bars 64 angularly spaced therearound on its conical surface 162. These bars cooperate with bar 68 on a complementary conically shaped portion of the housing. The refiner portion of the apparatus is of the double disc type and is of the same construction as that shown at FIGS. 7 and 8 of the drawings. In operation, pulp to be treated passes into nozzle 22 where, as indicated by the curved arrows, it passes to the radially innermost portion of conical member 160. It thereafter flows slantingly radially outwardly, between bars 64 and 68 and over conical surface 162 where it exits contiguous to the larger diameter or righthand end of conical member 160. From this point, the flow divides, with one portion going substantially radially outwardly through a first set of discs 76 and 780 and another portion going substantially horizontally, as indicated by the curved arrows. The portion which goes substantially horizontally then also passes substantially radially outwardly through the second set of discs 78 and 760, these being the righthand pair of discs as unit FIG. 13. It then exits between the discs, as indicated in the curved arrows, for transmission to subsequent treatment locations.

I claim:

1. A pulp refiner and pulp fluidizing apparatus for the treatment of paper pulp stock, the apparatus including a rotary pulp refiner and a rotary pulp fluidizer housed within a casing, at least a portion of the fluidizer being connected to and rotatable by a first shaft, at least a portion of the refiner being connected to and rotatable by a second shaft, said first and second shafts being coaxial to define a common axis and are rotatable independently of each other, whereby the fluidizer can be operated at a greater rotary speed than the rotary speed of the refiner, the output of the fluidizer being positioned contiguously to the input of the refiner, whereby the fluidizer deflocculates the paper pulp stock and the deflocculated stock substantially immediately passes to the input of the refiner while it is still deflocculated, whereby clogging of the refiner is inhibited and therefore higher paper pulp stock consistency can be refined by the disc refiner without clogging.

2. The apparatus of claim 1 wherein the pulp refiner is of the disc type.

3. The apparatus of claim 2 wherein the output from the fluidizer is located radially inwardly of the input to the disc refiner.

4. The apparatus of claim 1 wherein the fluidizer is defined by said first rotary shaft carrying a cylindrical member having angularly spaced raised portions on its exterior cylindrical surface, and by a stationary cylindrical member carried by the casing and having angularly spaced raised portions uniformly on its interior, cylindrical surface, the two said cylindrical surfaces being coaxial and the raised portions of each radially spaced from each other, the paper pulp stock being adapted to be fed to one axial end of the two cylindrical surfaces, and adapted to pass from the other axial end of the two cylindrical surfaces, said other axial end of the two cylindrical surfaces being positioned contiguously to the input of the refiner, the rotary speed of the fluidizer being completely independent of the rotary speed of the refiner.

5. The apparatus of claim 1 wherein the fluidizer is defined by said first rotary shaft carrying a conical member having angularly spaced raised portions on its exterior conical surface, and by a stationary conical conical portion of said casing, said conical casing portion having angularly spaced raised portions uniformly on its interior, conical surface, the two said conical surfaces being parallel to each other and having the same cone generating angle, with the raised portions of each radially spaced from each other, the paper pulp stock being adapted to be fed to the smaller radius axial end of the two conical surfaces, and adapted to pass from the larger radius, other axial end of the two conical surfaces, said other, larger radius axial end of the two conical surfaces being positioned contiguously to the input of the refiner.

6. The apparatus of claim 5 wherein said other, larger radius axial end of the said two fluidizer conical surfaces lies substantially in a radial plane which is at right angles to said common axis, and wherein the input zone to the pulp refiner lies substantially in said radial plane, the refiner being of the disc type having spaced, opposed ridges and wherein the spacing between the raised portions of said conical surfaces of said fluidizer is uniform and is greater than the spacing between the opposed ridges of the refiner.

7. The apparatus of claim 5 wherein said refiner is of the double disc type including a radially enlarged hub at one end of said second shaft, said hub provided with a plurality of angularly spaced, generally axially extending passage ports therethrough, one end of each passage port positioned contiguous to the outlet of the fluidizer and the other end of each passage port positioned contiguous to the input zone of one of the two refiners, whereby one portion of the output of the deflocculated paper pulp stock from the fluidizer feeds to the input of the one of the disc refiners and whereby the remaining portion of the fluidizer output feeds through the passage ports to the input of the other of the disc refiners of said double disc refiner.

8. A pulp refiner and pulp fluidizing apparatus for the treatment of paper pulp stock, the apparatus including a rotary pulp refiner and a rotary pulp fluidizer housed within a casing, at least a portion of the fluidizer being connected to and rotatable by a first shaft, at least a portion of the refiner being connected to and rotatable by a second shaft, said first and second shafts being coaxial to define a common axis and are rotatable independently of each other, whereby the fluidizer can be operated at a greater rotary speed than the rotary speed of the refiner, the output of the fluidizer being positioned contiguously to the input of the refiner, whereby the fluidizer deflocculates the paper pulp stock and the deflocculated stock substantially immediately passes to the input of the refiner while it is still deflocculated, whereby clogging of the refiner is inhibited and therefore higher paper pulp stock consistency can be refined by the disc refiner without clogging, and wherein the fluidizer includes a first rotary hub driven by a hollow, rotary drive member, the latter being said first shaft, the first rotary hub being centrally apertured and receiving one end of the hollow rotary drive member, the hollow drive member adapted to carry paper pulp stock, the fluidizer also including a second rotary hub generally parallel to and axially spaced from said first rotary hub and rotated by said second shaft, at least a portion of the opposing faces of said fluidizer hubs each carrying angularly spaced raised portions, the raised portions of the two hubs being spaced from each other during relative rotation of the first and second hubs, the refiner being of the disc type having opposed ridges, the spacing between the opposed raised portions of the fluidizer hubs being greater than the spacing between the opposed ridges of the refiner, the second rotary hub being provided with a plurality of angularly spaced, generally axially extending passage ports therethrough, and including a second disc refiner housed within the casing and axially spaced from the first disc refiner, one end of each passage port positioned contiguous to the fluidizer and the other end of each passage port positioned contiguous to the input zone of the second disc refiner, whereby one portion of the output of the deflocculated paper pulp stock from the fluidizer feeds to the input of the first disc refiner and whereby the remaining portion of the fluidizer output feeds through the passage ports to the input of the second disc refiner.

* * * * *